United States Patent [19]

Castro

[11] 4,450,967

[45] May 29, 1984

[54] ARCHERY RACK

[76] Inventor: Robert J. Castro, 109 Dale Dr., Rockville, Md. 20850

[21] Appl. No.: 248,350

[22] Filed: Mar. 24, 1981

[51] Int. Cl.[3] ..... A47F 7/00

[52] U.S. Cl. ..... 211/13; 211/60 R; D6/188

[58] Field of Search ..... 211/60 R, 13; D6/188; D19/85; 211/69, 69.5

[56] References Cited

U.S. PATENT DOCUMENTS

| | | | |
|---|---|---|---|
| D. 41,945 | 11/1911 | Heinz | 211/60 R |
| D. 59,130 | 9/1921 | Samstag | D6/188 |
| D. 110,692 | 8/1938 | Durell | D6/188 |
| 1,472,820 | 11/1923 | White | 211/69 X |
| 2,745,558 | 5/1956 | Greenspan | 211/60 R |
| 3,082,878 | 3/1963 | Thomas | 211/60 R |

FOREIGN PATENT DOCUMENTS

| | | | |
|---|---|---|---|
| 1461711 | 1/1969 | Fed. Rep. of Germany | 211/69.5 |
| 14448 | of 1895 | United Kingdom | 211/60 R |

*Primary Examiner*—Ramon S. Britts
*Assistant Examiner*—Robert W. Gibson, Jr.
*Attorney, Agent, or Firm*—Haight & Associates

[57] ABSTRACT

An archery equipment storage rack includes a base member, in the form of a cabinet or shelf, on which are supported radially spaced, concentric and geometrically similar outer and inner frame members. Angularly spaced apertures in the outer frame member are radially aligned with respective angularly spaced recesses in the inner frame member so that arrows can be stored with their tips in the recesses and their shafts supported in respective apertures in a fan-shaped pattern wherein the arrow feathers are spaced further apart than the arrow tips. At least one pair of support pegs extends forwardly from the outer frame member to support a bow horizontally. In the preferred embodiment the inner frame is semi-circular and the outer frame is semi-annular, permitting arrows to be supported along substantially the entire 180° of arc of the frame members.

12 Claims, 3 Drawing Figures

ARCHERY RACK

TECHNICAL FIELD

The present invention relates to storage racks for archery equipment.

BACKGROUND OF THE INVENTION

Storage racks for bows, arrows and miscellaneous other archery equipment are well known in the prior art. Examples of such racks are found in U.S. Pat. Nos. 2,745,558 (Greenspan), 3,082,878 (Thomas) and 3,840,282 (Major). The objectives sought in designing such racks are minimization of required space, aesthetic appearance, and secure support of the equipment without damage thereto. For example, the Thomas patent recognizes that the arrow feathers can best be protected in that the arrows are stored in a fan-like pattern with the tips closer together than the spaced feathers and that the fanned-out feathers are appealing to the eye. However, the rack disclosed by Thomas provides this fanned-out arrow support by using two vertically spaced horizontally-extending members wherein apertures in the top member are aligned with recesses in the bottom member, the recesses in the bottom member being more closely spaced than the apertures to provide for the fan-like storage. There is considerable wasted space in this arrangement due to the fact that the space beyond the ends of the line of recesses in the lower member cannot receive arrow tips. Further, there is a severe limitation as to the number of arrows which can be supported in a fan-like pattern between the two parallel members because each succeeding arrow spaced from the vertically-stored center arrow is engaged closer to the feathers in its upper member aperture; therefore, the feathers serve as a limit as to how far the pattern of apertures can extend along the upper member width. Still further, apart from the practical effect of limiting the number of stored arrows, the resulting very short fan-shaped pattern of stored arrows has limited aesthetic appeal.

SUMMARY OF THE INVENTION

It is therefore an object of the present invention to provide a storage or support rack which protectively secures bows, arrows and miscellaneous archery equipment in a minimum amount of space per stored arrow while providing an attractive display of the stored equipment.

In accordance with my invention, an archery equipment storage rack includes a base, serving as a storage cabinet or shelf, atop which is mounted a pair of spaced geometrically similar frame members disposed concentrically about a horizontal axis. A series of angularly-spaced, radially-extending apertures in the outer frame member are aligned with respective recesses formed in the outer edge of the inner frame member. Arrows inserted tip first through an aperture can be supported at their tips by a respective recess and along their shafts by that aperture. The geometric similarity and concentric relationships between the frame members permits arrows to be supported over 180° of frame member arc without any wasted space at the ends of the frame member. Moreover, the concentric frame member relationship permits each arrow to be supported at the same location along its shaft in its support aperture. The full 180° arc, or shorter if desired, not only maximizes the number of arrows that can be stored in a given rack width, but it also provides an extremely eye-appealing display.

A pair of pegs, or the like, project forwardly from the upper frame member at the same height, but on different sides of its apex, to support a bow horizontally. The rack stores miscellaneous equipment in the base and can be suspended from a wall or other structural support.

BRIEF DESCRIPTION OF THE DRAWINGS

The above and still further objects, features and advantages of the present invention will become apparent upon consideration of the following detailed description of the plural embodiments thereof, especially when taken in conjunction with the accompanying drawings, wherein.

DESCRIPTION OF THE PREFERRED EMBODIMENTS

Figure 1:
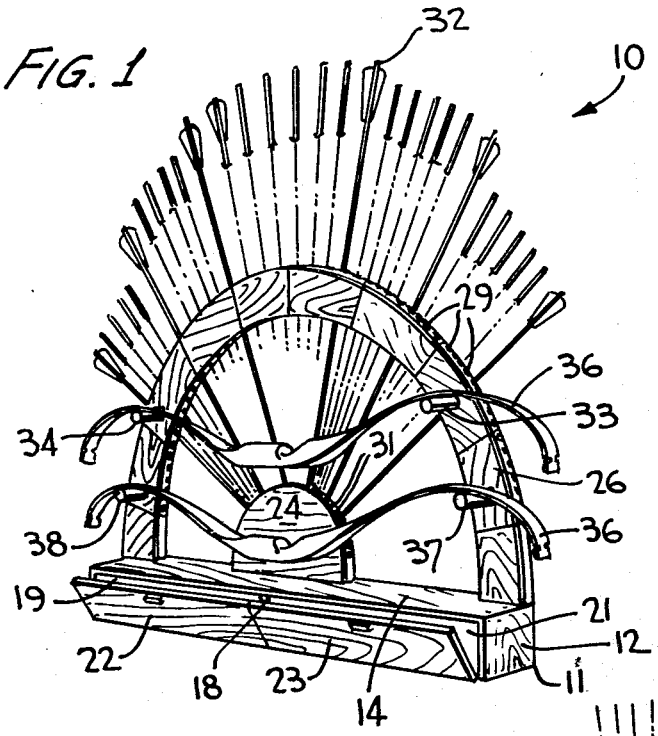
FIG. 1 is a view in perspective of a preferred embodiment of the present invention.
Figure 2:
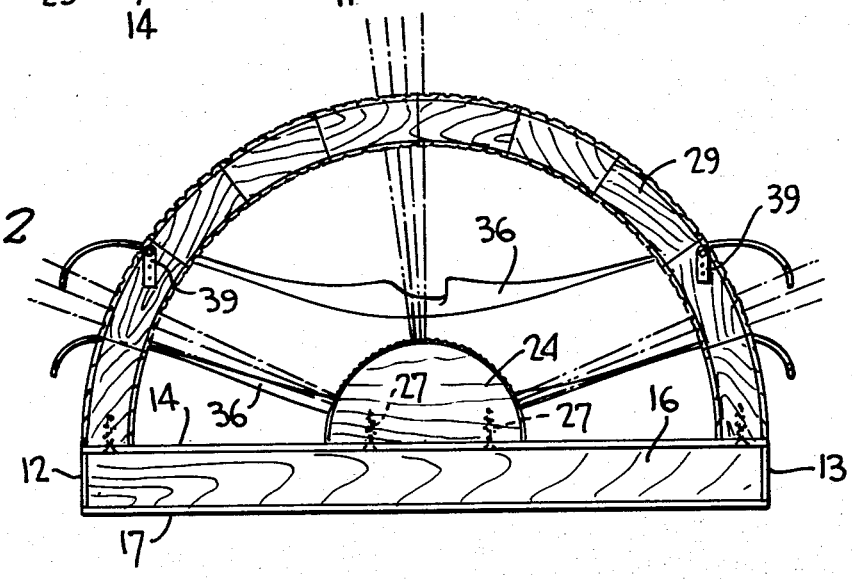
FIG. 2 is a rear plan view of the embodiment of FIG. 1.

Referring specifically to FIGS. 1 and 2 of the accompanying drawings, an archery equipment storage rack 10 includes a base member 11 in the form of a rectangular parallelepiped with square (for purposes of example only) side walls 12, 13 and elongated top, rear and bottom walls 14, 16 and 17, respectively. The front wall 18 has defined therein two side-by-side recesses 19, 21 serving as cabinets which are covered by respective panels 22, 23 hinged to wall 18 along their lower edges.

An inner frame member 24 is, in the embodiment, semi-circular and secured along its diametric edge, by screws 27, or the like, along the rear edge of top wall 14 to base 11. The horizontal diameter of inner frame member 24 extends along and is centrally disposed with respect to the width dimension of base 11, the diameter of inner frame 24 being considerably smaller than that width dimension. A semi-annular outer frame 26 is concentrically disposed about and spaced from inner frame 24 and secured at its ends by screws 28, or the like to the ends of the rear edge of top wall 14. A plurality of angularly spaced, radially-extending through-holes 29 are defined through outer frame 26. A like plurality of bores or recesses 31 are defined in the upwardly facing edge of inner frame 24, each bore 31 being radially aligned with a respective aperture or through hole in outer frame 26. Bores 31 and apertures 29 are sized, in cross-section, to axially receive and support arrows 32. Specifically, an arrow may be inserted, tip first, through aperture 29 into the corresponding aligned bore 31 whereby the shaft, below the feather, is supported in aperture 29 while the tip is supported in bore 31. The arrows 32 are therefore individually supported at two locations along their lengths. In addition, because of the radial alignment of holes 29 and bores 31, and angular spacing between sequential holes and sequential bores, the arrows are supported in an aesthetically appealing fan shaped pattern with the feathers at the widened end of the fan.

A pair of pegs 33-34 extend forwardly from the forward-facing surface of outer frame 26 proximate opposite ends of the frame and at the same horizontal level. In this manner a bow 36 may be horizontally supported by the two pegs. A second pair of similar pegs 37, 38 may be provided for supporting a second bow. The pegs 33, 34, 37, 38 may be threaded or glued in suitably provided holes in the outer frame 26.

A plurality of hanging elements, such as hooks 39, are secured by means of nails, or the like, to the rearward-facing surface of outer frame 26. Elements 39 permit the entire rack to be hung on a wall or other support structure.

The disposition of frame members 24 and 26 about a common axis, extending perpendicular to the plane of the paper at their radial centers, permits each arrow to be supported in an aperture at the same point along its length from its tip. The arrow feathers, therefore, do not limit the number of arrows that can be mounted, unlike the prior art. In addition, no space along the width dimension (i.e. along the path of sequential apertures) of the frame members, particularly the inner frame 24, need be wasted as in the prior art.

It should be noted, of course, that the concentric frame members need not be circular and annular and still will reside within the spirit of this invention. For example, with reference to FIG. 3, any geometrically similar polygonal frame members can serve the desired function. More specifically, a base 41 is adapted to receive two drawers 42, 43 which slide in and out from its forward wall. Inner frame member 44 is in the shape of a triangular block secured to the top wall of base 41 along one of its three edges. The two remaining edges of member 44 are exposed and are provided with recesses 46 extending in a series along the lengths of these exposed edges. Outer frame member 47 includes a pair of legs which are spaced from and parallel to respective exposed edges of member 44. These legs of outer frame 47, along with a subtended portion of the top of base 41, form a triangle which is geometrically similar to the triangle defined by the edges of member 44. Apertures 48 are spaced along the length of the legs of frame 47 and are aligned with respective recesses 46 in frame 44:

It should be noted that the arcuate embodiment of FIGS. 1 and 2 need not include semi-circular frame members; rather, each frame member can take the form of one or more segments of a circle subtending any desired arc up to 180°. These segments could be truncated at their ends, whereby the overall width of the rack is reduced at the sacrifice of arrow storage space. Alternatively, the radial centers of the frame members may be located below the top wall 14 of base 11. Further, the apertures 29 and recess 31 need not extend along the entire lengths of the frame members, again at the expense of arrow storage capacity.

Figure 3:
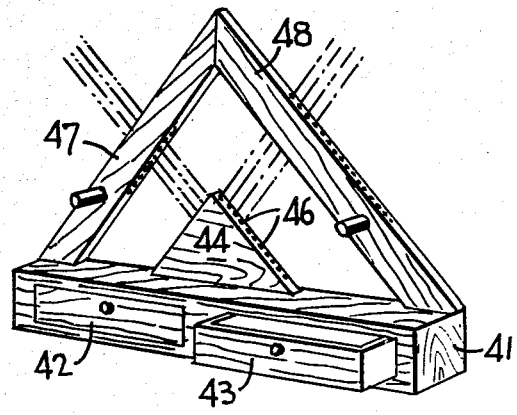
FIG. 3 is a view in perspective of an alternative embodiment of the invention.

The embodiment of FIG. 3 need not have triangular frames but could instead be frames configured to include up to 180° of any geometrically similar polygons.

Instead of through-holes or apertures 29 and/or recess 31, retaining clips may be provided for the arrows on the forward and/or rear surfaces of the frames. Other means for retaining the arrows may be employed. In addition, the arrows need not be retained in a single fan-shaped row but instead may be stored in two or more rows with the holes or other retaining means in different rows spaced to preclude contact between the feathers of adjacent arrows. The important feature, in this regard, is that the radially inner and radially outer retaining means for the arrows define respective paths which define up to 180° of concentric and geometrically similar figures such as circles, polygons, ellipses, etc.

The cabinet (FIG. 1) or drawer space (FIG. 3) in the base may be eliminated in favor of at least one shelf, if desired. The support pegs 33, 34, 37 and 38 may be provided in any desired quantity to support various archery-related equipment. The rack may be made of wood, plastic or metal.

While I have described and illustrated a plurality of embodiments of my invention, it will be clear that variations of the details of construction which are specifically illustrated and described may be resorted to without departing from the true spirit and scope of the invention as defined in the appended claims.

I claim:

1. A storage rack for archery equipment including at least one pair of spaced, horizontally aligned projecting members for supporting at least one bow in a horizontal position, said projecting members being secured to and extending forwardly from means for supporting a plurality of arrows in at least two non-parallel axes, said rack being further characterized in that said means for supporting arrows comprises:

a first plurality of retaining means for the tips of said arrows disposed sequentially along a first predetermined path;

a second plurality of retaining means for the shafts of said arrows disposed sequentially along a second predetermined path;

wherein said first and second predetermined paths define non-rectangular polygonal or circular segments up to a 180° arc of the corresponding enclosed polygon or circle members which are geometrically similar but of different sizes; and means for supporting said first and second pluralities of retaining means with said enclosed members disposed concentrically and with each arrow tip retaining means of said first plurality being radially aligned with an arrow shaft retaining means in said second plurality.

2. The storage rack according to claim 1, wherein said means for supporting comprises a first frame member supporting said first plurality of retaining means and a second frame member supporting said second plurality of retaining means, said first and second frame members being spaced from one another.

3. The storage rack according to claim 2 further comprising a base member for providing storage space for additional archery-related equipment, said base member having a top surface, wherein said first and second frame members extend above said base members such that the geometric center of said enclosed members is located no higher than said top surface.

4. Ths storage rack according to claims 1, 2 or 3, wherein said enclosed members are circles.

5. The storage rack according to claims 2 or 3, wherein said first frame member is generally semi-circular and said second frame member is semi-annular and disposed concentrically about and spaced from said first frame member.

6. The storage rack according to claim 5, wherein said first frame member has an exposed semi-circular edge and wherein said first plurality of retaining means are a plurality of recesses defined in sequential angular locations along said edge; and wherein said second plurality of retaining means comprises a plurality of apertures defined radially through said second frame at successive angular locations.

7. The storage rack according to claims 1, 2 or 3, wherein said enclosed members are polygonal.

8. The storage rack according to claims 2 or 3, wherein said first frame member is a solid polygon and said second frame member is a larger polygon disposed concentrically about said first member and having its interior cut out so that the second frame member is radially spaced from said first frame member.

9. The storage rack according to claim 8, wherein said first frame member includes an exposed edge peripherally defining said solid polygon, wherein said first plurality of retaining means comprises a series of angularly spaced recesses defined in said exposed edge, and wherein said second plurality of retaining means comprises a series of angularly spaced apertures radially defined through said second frame member.

10. The storage rack according to claim 3, wherein said first and second predetermined paths are generally arcuate.

11. The storage rack according to claim 3, wherein storage space is enclosed in said base.

12. The storage rack according to claim 3 further comprising at least one pair of peg-like members secured to and extending forwardly from said second frame member at spaced, horizontally-aligned locations for supporting a bow in a horizontal position.

* * * * *

UNITED STATES PATENT AND TRADEMARK OFFICE

CERTIFICATE OF CORRECTION

PATENT NO. : 4,450,967

DATED : May 29, 1984

INVENTOR(S) : Robert J. Castro

It is certified that error appears in the above-identified patent and that said Letters Patent are hereby corrected as shown below:

Claims 4 and 8 should be correctly shown as follows:

Claim 4. The storage rack according to claims 1, 2 or 3, wherein said enclosed members are circles.

Claim 8. The storage rack according to claims 2 or 3, wherein said first frame member is a solid polygon and said second frame member is a larger polygon disposed concentrically about said first frame member and having its interior cut out so that the second frame member is radially spaced from said first frame member.

Signed and Sealed this

*Ninth* Day of *October 1984*

[SEAL]

*Attest:*

*Attesting Officer*

GERALD J. MOSSINGHOFF

*Commissioner of Patents and Trademarks*